US009338535B2

(12) United States Patent
Shao et al.

(10) Patent No.: US 9,338,535 B2
(45) Date of Patent: May 10, 2016

(54) MICRO-SPEAKER

(71) Applicants: Yi Shao, Shenzhen (CN); Haifei Huang, Shenzhen (CN); Yunxia Xu, Shenzhen (CN)

(72) Inventors: Yi Shao, Shenzhen (CN); Haifei Huang, Shenzhen (CN); Yunxia Xu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/525,441

(22) Filed: Oct. 28, 2014

(65) Prior Publication Data

US 2016/0021441 A1 Jan. 21, 2016

(30) Foreign Application Priority Data

Jul. 18, 2014 (CN) ..... 2014 2 0401965 U

(51) Int. Cl.

| | |
|---|---|
| ***H04R 9/06*** | (2006.01) |
| ***H04R 1/00*** | (2006.01) |
| ***H04R 7/00*** | (2006.01) |
| ***H04R 9/10*** | (2006.01) |
| ***H04R 1/24*** | (2006.01) |
| ***H04R 9/02*** | (2006.01) |

(52) U.S. Cl.

CPC .. *H04R 1/00* (2013.01); *H04R 1/24* (2013.01); *H04R 7/00* (2013.01); *H04R 9/025* (2013.01); *H04R 9/063* (2013.01); *H04R 9/10* (2013.01); *H04R 2209/026* (2013.01); *H04R 2499/11* (2013.01)

(58) Field of Classification Search

CPC ..... H04R 1/24; H04R 1/2803; H04R 1/403; H04R 9/025; H04R 9/063; H04R 9/10; H04R 2209/026; H04R 2499/11; H04M 1/03; H04M 1/035

USPC ..... 381/335, 338, 345, 349, 350, 351, 182, 381/186, 189, 386, 388, 396, 401, 412; 181/144, 145, 199; 379/430, 431, 379/433.02

See application file for complete search history.

(56) References Cited

U.S. PATENT DOCUMENTS

| | | | | |
|---|---|---|---|---|
| 6,711,274 | B2 * | 3/2004 | Asahina | H04M 1/03 381/182 |
| 6,744,895 | B2 * | 6/2004 | Miyamoto | H04R 9/063 381/182 |
| 7,142,686 | B2 * | 11/2006 | Furuya | H04M 1/035 381/182 |

* cited by examiner

*Primary Examiner* — Huyen D Le

(74) *Attorney, Agent, or Firm* — IPro, PLLC; Na Xu

(57) ABSTRACT

A micro-speaker is disclosed. The micro-speaker includes a frame, a magnetic circuit unit in the frame, a first vibration unit, and a second vibration unit. The magnetic circuit unit forms a first volume cooperatively with the first vibration unit, and a second volume cooperatively with the second vibration unit. The magnetic circuit unit further includes an aperture for communicating the first volume with the second volume for enabling the first vibration unit in phase with the second vibration unit.

13 Claims, 5 Drawing Sheets

MICRO-SPEAKER

FIELD OF THE INVENTION

The present invention relates to electroacoustic apparatuses, more particularly to a micro-speaker used in an electronic device for converting electrical signals to audible sounds.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of micro-speakers have been developed. An micro-speaker is generally coupled to an audio equipment or an amplifier for use as a large sound producing means for considerably amplifying volume. Alternatively, the micro-speaker may be used as a small sound producing means having a small size and volume.

An electronic device, such as a cellular phone, a camcorder, a PDA, a digital camera, or a notebook computer, provides a space for accommodating a micro-speaker therein. Nowadays, a micro-speaker with high quality audio performance and miniature size is desired.

A typical micro-speaker related to the present disclosure includes a vibration unit having a diaphragm, a magnetic circuit unit having a magnet, and a housing for receiving the vibration unit and the magnetic circuit unit therein. For improving the low frequency sound performance, this kind of micro-speaker generally provides a diaphragm or a magnet having relatively greater weight. Or, the micro-speaker includes two speaker units having the same configurations. Diaphragm having greater weight, however, will result in unbalanced vibration which will badly affect the sound quality. Larger magnet or two speaker units will increase the volume of the micro-speaker.

Accordingly, an improved micro-speaker which can overcome the disadvantages described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
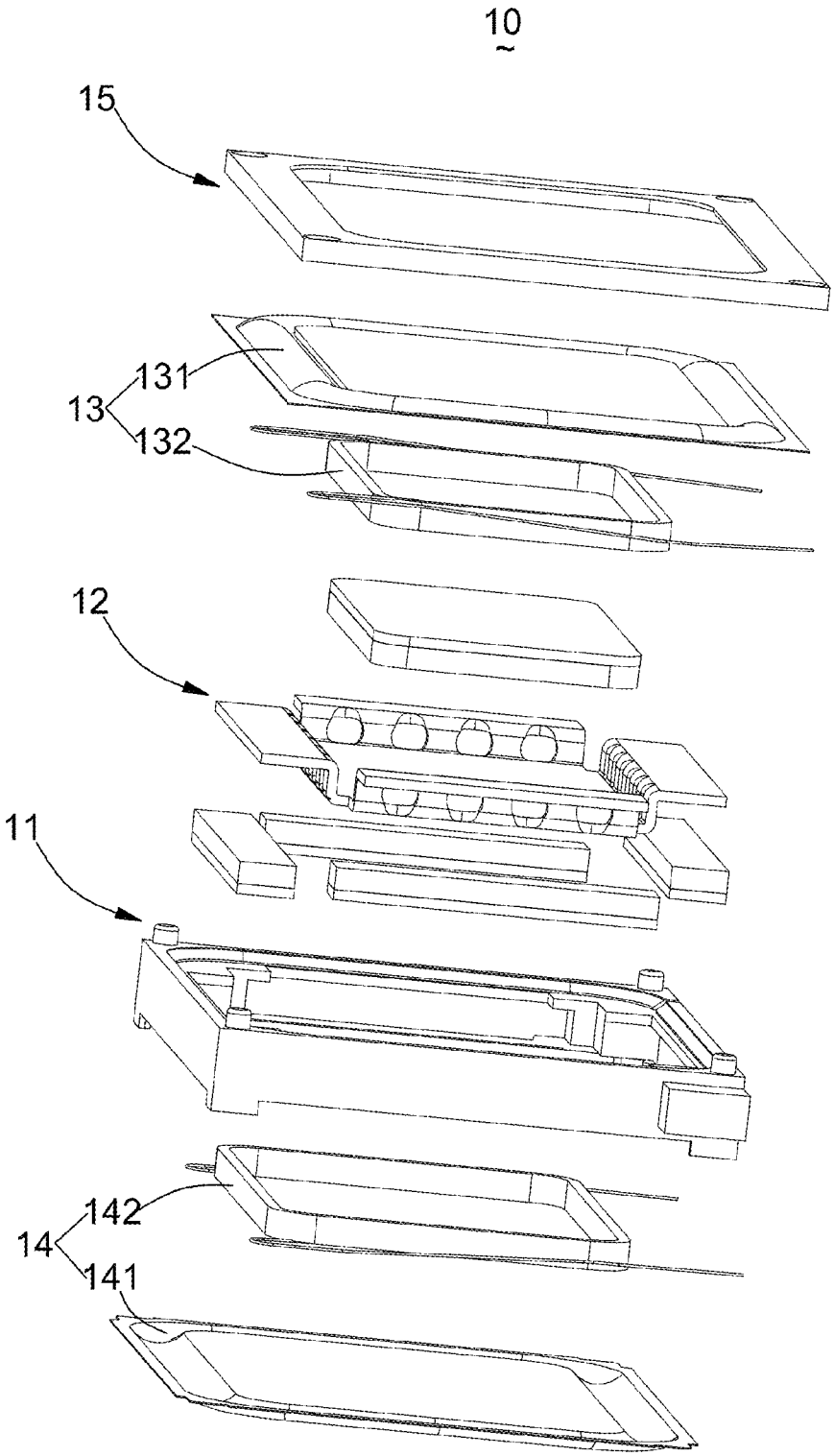
FIG. 1 is an isometric and exploded view of a micro-speaker in accordance with an exemplary embodiment of the present disclosure.

Referring to FIG. 1 which is an isometric and exploded view of a micro-speaker 1*o* in accordance with an exemplary embodiment of the present disclosure, the micro-speaker 10 is used in an electrical device such as a notebook, a mobile phone, a portable consumer device for converting electrical signals to audible sounds. The micro-speaker 10 includes a frame 11, a magnetic circuit unit 12 positioned by the frame 11, a first vibration unit 13 supported by the frame 11, a second vibration unit 14 supported by the frame 11, and a cover 15 engaging with the frame 11 for forming a housing. The first and second vibration units 13, 14 interacts with the magnetic circuit unit 12 for producing sounds by means of vibrations. The first vibration unit 13 includes a first diaphragm 131 and a first voice coil 132 directly or indirectly connecting with the first diaphragm 131. Similarly, the second vibration unit 14 includes a second diaphragm 141 and a second voice coil 142 directly or indirectly connecting with the second diaphragm 141. When electrified, the first and second voice coils 132, 142 drive the first and second diaphragms 131, 141 to vibrate for generating audible sounds due to Lorenz Force produced by the interaction between the voice coils and the magnetic circuit unit 12.

Figure 2:
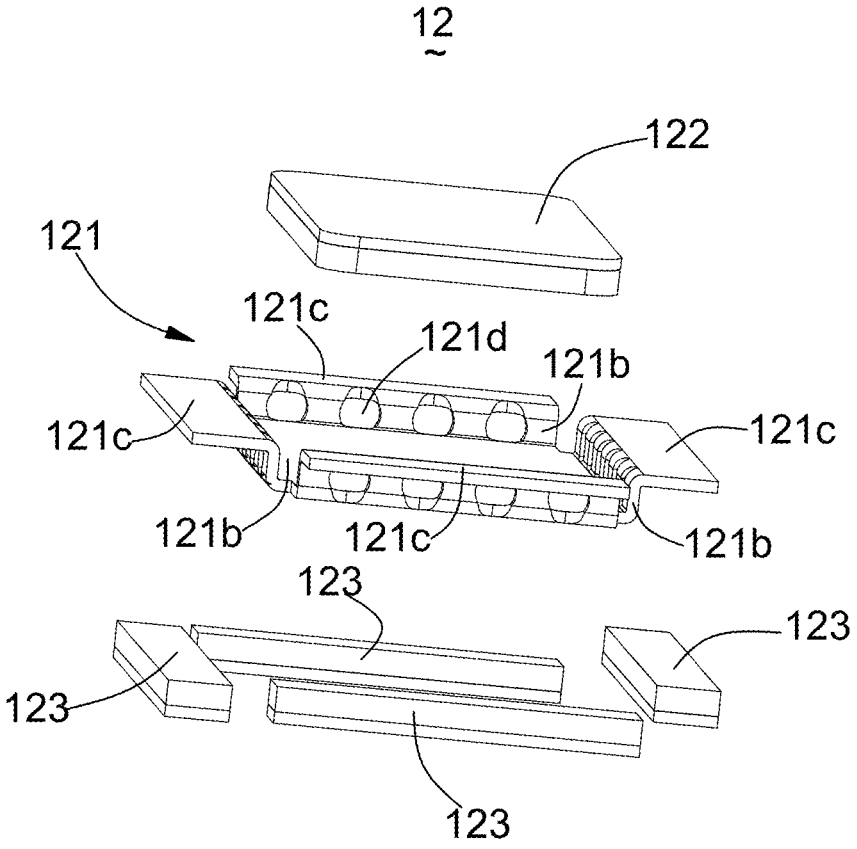
FIG. 2 is an exploded view of a magnetic circuit unit of the micro-speaker in FIG. 1.

Referring to FIG. 2, an exploded view of the magnetic circuit unit 12, the magnetic circuit unit 12 includes a yoke 121 made of magnetic conduct material, a first magnet assembly 122 coupled with the yoke 121, and a second magnet assembly 123 couple with the yoke 121. The first magnet assembly 122 comprises a permanent magnet and a pole plate attached to the permanent magnet, or comprises a permanent magnet without a pole plate attached thereto. Similarly, the second magnet assembly 123 comprises a permanent magnet and a pole plate attached to the permanent magnet, or comprises a permanent magnet without a pole plate attached thereto. In this embodiment, the second magnet assembly 123 comprises four separated parts. In fact, alternatively, the second magnet assembly 123 may be a single ring. The yoke 121 comprises a bottom 121*a*, a plurality of sidewalls 121*b* extending upwardly from peripheries of the bottom 121*a*, and a plurality of flanges 121*c* extending perpendicularly from the sidewalls 121*b* along a direction away from a center of the bottom 121*a*. Thus, the flanges 121*c* are parallel to but not overlap with the bottom 121*a*. Further, the sidewall 121*b* defines a plurality of apertures 121*d* therethrough. FIG. 2 shows that each of the sidewalls 121*b* defines a plurality of apertures 121*d*. In fact, only selected sidewalls 121*b* include the apertures 121*d*, and other sidewalls 121*b* do not include the apertures 121*d*. Another word, at least one of the sidewalls 121*b* includes at least one aperture 121*d*.

Figure 3:
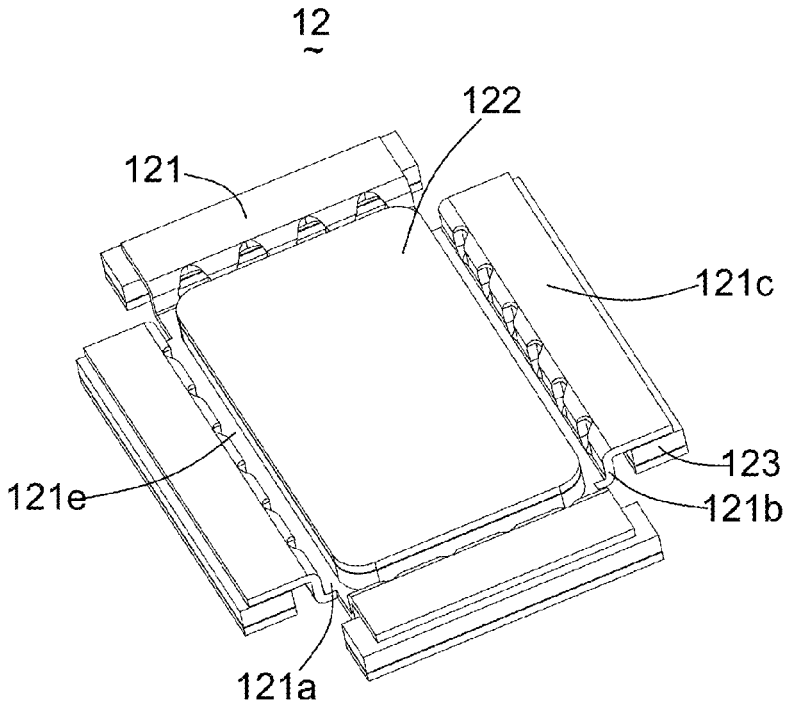
FIG. 3 is an assembled view of the magnetic circuit unit in FIG. 2, from a first aspect.

Referring to FIG. 3, an assembled view of the magnetic circuit unit 12, the first magnet assembly 122 locates on the bottom 121*a* of the yoke 121, with an outer surface thereof keeping a distance from the sidewalls 121*b* of the yoke, for forming a first magnetic gap 121*e* between the outer surface of the first magnet assembly 122 and the sidewalls 121*b*.

Figure 4:
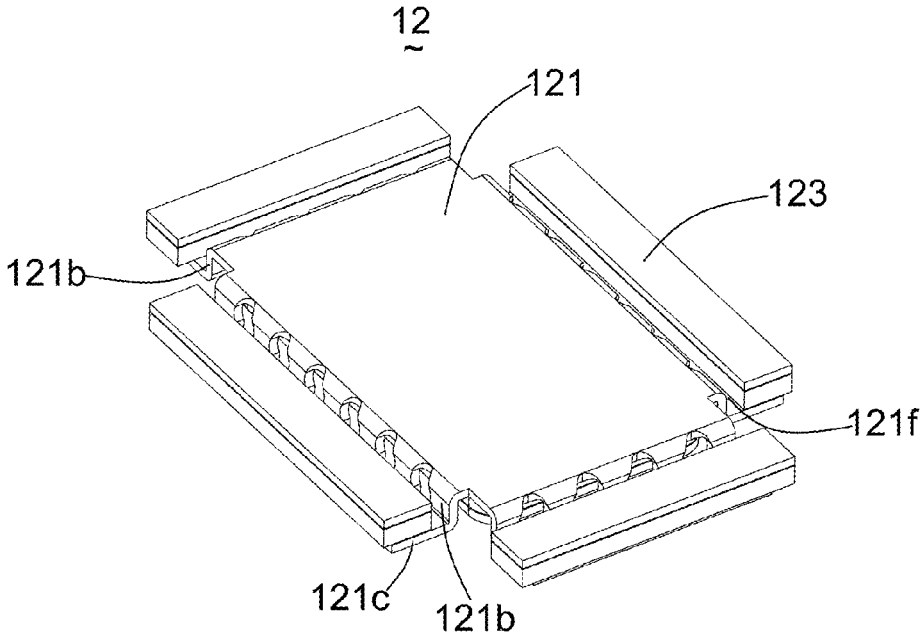
FIG. 4 is an assembled view of the magnetic circuit unit in FIG. 2, from a second aspect opposed to the first aspect.

Referring to FIG. 4 that is an assembled view of the magnetic circuit unit 12 from another aspect opposite to FIG. 3, the second magnet assembly 123 locates on the flanges 121*c* with an inner surface thereof keeping a distance from the sidewall 121*b* for forming a second magnetic gap 121*f*. By virtue of the configuration described above, the first and second magnet assemblies 122, 123 define two magnetic gaps

121*e*, 121*f* formed at two opposite sides of the yoke 121, and the sidewall 121*b* is a common component for forming the two magnetic gaps.

Figure 5:
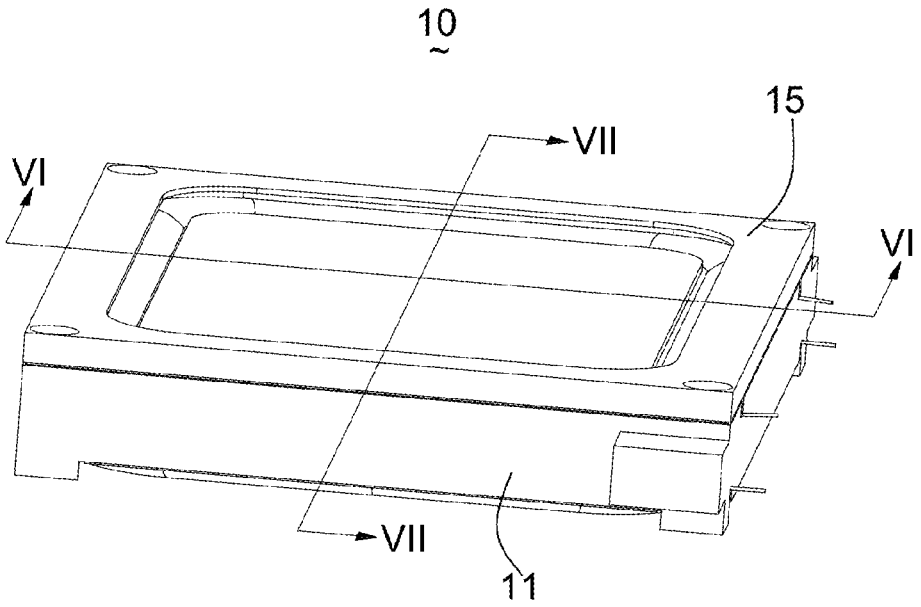
FIG. 5 is an isometric and assembled view of the micro-speaker in FIG. 1.
Figure 6:
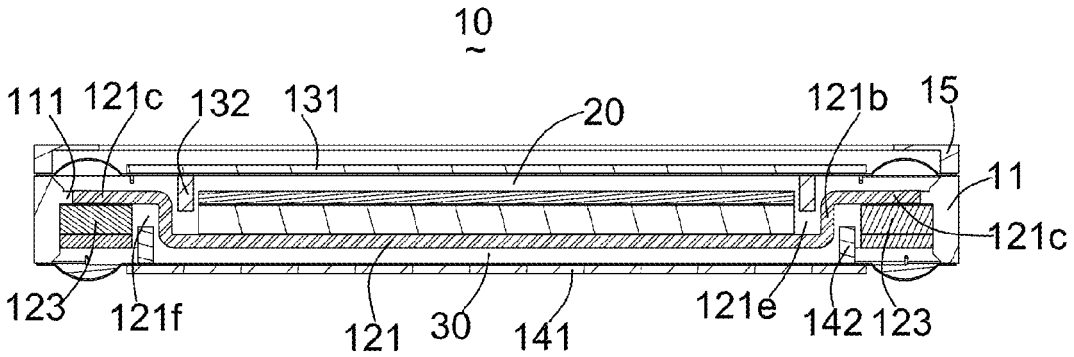
FIG. 6 is a cross-sectional view of the micro-speaker taken along line VI-VI in FIG. 5.
Figure 7:
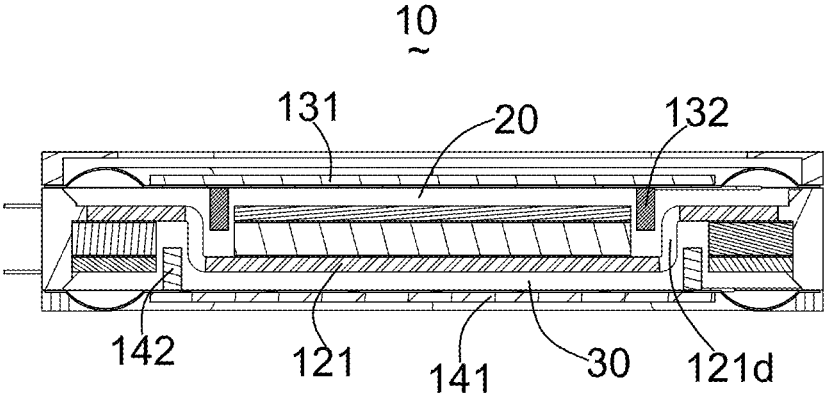
FIG. 7 is a cross-sectional view of the micro-speaker taken along line VII-VII in FIG. 5.

Referring to FIGS. 5-7, when assembled, the cover 15 engages with the frame 11 for providing the housing to accommodate the magnetic circuit, the vibration units therein. The frame 11 includes an inner rib 111 extending toward a center thereof for abutting against the flanges 121*c* of the yoke to position the yoke in the frame 11. An edge of the first diaphragm 131 attaches to an upper surface of the frame 11, and an edge of the second diaphragm 141 attaches to a lower surface of the frame 11. The first voice coil 132 suspends in the first magnetic gap 121*e* with one end thereof connected to the first diaphragm 131. The second voice coil 142 suspends in the second magnetic gap 121*f* with one end thereof connected to the second diaphragm 141. A first volume 20 is formed between the first diaphragm 131 and the yoke 121 and the first volume 20 is communicated with the first magnetic gap 121*e*. A second volume 30 is accordingly formed between the yoke 121 and the second diaphragm 141, and the second volume 30 is communicated with the second magnetic gap 121*f*. Optionally, a part of the second magnet assembly 123 locates on the flange 121*c* of the yoke 121, and another part of the second magnet assembly 123 locates on the inner rib 111 of the frame 11, thereby increasing the distance between the inner surface of the second magnet assembly 123 and the sidewall 121*b*. In addition, by virtue of the second magnet assembly 123 which is contemporary attached to the flange 121*c* and the inner rib 111, the frame 11 and the magnetic circuit unit can be coupled to each other firmly.

Referring to FIG. 7, the first volume 20 is separated from the second volume 30 by the yoke 121, but is communicated with each other via the aperture 121*d* defined in the sidewall of the yoke 121. When the first diaphragm 131 moves downwardly due to the Lorenz Force produced by the first voice coil 132, the air in the first volume 20 will be pressed and leak into the second volume 30 via the aperture 121*d* thereby pushing the second diaphragm 141 to move downwardly. Thus, the first and second diaphragms move in a same direction. Similarly, when the first diaphragm 131 move upwardly, the first volume 20 will be enlarged and the air in the second volume 30 will flow into the first volume 20 thereby forcing the second diaphragm 141 to move upwardly. The same situation will accordingly occur when the second diaphragm move initiatively. Synchronous movements of the first and second diaphragms along the same direction will effectively enhance the low frequency sound quality. Alternatively, the first and second voice coils may be electrified by one electrical signal contemporarily.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A micro-speaker, comprising:

a frame providing a receiving space;

a magnetic circuit unit accommodated in the receiving space, the magnetic circuit unit including a first magnetic gap and a second magnetic gap arranged at two opposite sides of the magnetic circuit unit, the magnetic circuit unit further including an aperture;

a first vibration unit including a first diaphragm and a first voice coil with an end suspending in the first magnetic gap for driving the first diaphragm;

a second vibration unit including a second diaphragm and a second voice coil with an end suspending in the second magnetic gap for driving the second diaphragm;

a first volume formed between the first diaphragm and the magnetic circuit unit;

a second volume formed between the second diaphragm and the magnetic circuit unit, the second volume being separated by the magnetic circuit unit from the first volume and communicated with the first volume via the aperture;

the magnetic circuit unit including a yoke, a first magnet assembly positioned on a first surface of the yoke, and a second magnet assembly positioned on a second surface of the yoke opposed to the first surface;

the yoke including a bottom, a plurality of sidewalls extending vertically from the bottom, and a plurality of flanges extending vertically from the sidewalls, the flanges being parallel to the bottom.

2. The micro-speaker as described in claim 1, wherein the first magnet assembly locates on the bottom of the yoke with an outer surface thereof keeping a distance from the sidewall of the yoke for forming the first magnetic gap, the second magnet assembly locates on the flange with an inner surface thereof keeping a distance from the sidewall for forming the second magnetic gap.

3. The micro-speaker as described in claim 2, wherein the aperture is defined in the sidewall.

4. The micro-speaker as described in claim 1, wherein the frame further includes an inner rib extending toward a center thereof for engaging with the magnetic circuit unit.

5. The micro-speaker as described in claim 4, wherein a part of the second magnet assembly locates on the inner rib of the frame.

6. The micro-speaker as described in claim 1 further including a cover engaging with the frame for forming a housing.

7. A micro-speaker, comprising:

a housing forming a receiving space;

a magnetic circuit unit accommodated in the receiving space, the magnetic circuit unit including a yoke having an aperture, a first magnet assembly located on one side of the yoke, a second magnet assembly located on another side of the yoke, a first magnetic gap formed by the first magnet assembly and the yoke, and a second magnetic gap formed by the second magnet assembly and the yoke;

a first diaphragm facing the first magnet assembly for forming a first volume therebetween;

a voice coil suspended in the first magnetic gap for driving the first diaphragm;

a second diaphragm facing the second magnet assembly for forming a second volume therebetween;

a second voice coil suspended in the second magnetic gap for driving the second diaphragm;

the first volume being communicated with the second volume for enabling the first diaphragm in phase with the second diaphragm;

the yoke including a bottom, a plurality of sidewalls extending vertically from the bottom, and a plurality of flanges extending vertically from the sidewalls, the flanges being parallel to the bottom.

8. The micro-speaker as described in claim 7, wherein the first magnet assembly locates on the bottom of the yoke with an outer surface thereof keeping a distance from the sidewall of the yoke for forming the first magnetic gap, the second magnet assembly locates on the flange with an inner surface thereof keeping a distance from the sidewall for forming the second magnetic gap.

9. The micro-speaker as described in claim 7, wherein the aperture is defined in the sidewall.

10. The micro-speaker as described in claim 7, wherein the frame further includes an inner rib extending toward a center thereof for engaging with the magnetic circuit unit.

11. The micro-speaker as described in claim 10, wherein a part of the second magnet assembly locates on the inner rib of the frame.

12. The micro-speaker as described in claim 7, wherein the frame further includes an inner rib extending toward a center thereof, a part of the second magnet assembly locates on the inner rib and another part of the second magnet assembly locates on the flange.

13. The micro-speaker as described in claim 7 further including a cover engaging with the frame for forming a housing.

* * * * *